US010391545B2

(12) United States Patent
Kuniyil et al.

(10) Patent No.: US 10,391,545 B2
(45) Date of Patent: Aug. 27, 2019

(54) SELF-ALIGNING RIVETING METHOD

(71) Applicant: The Boeing Company, Chicago, IL (US)

(72) Inventors: Pradeepan Kuniyil, Melbourne (AU); Blair Larsson, Eltham (AU)

(73) Assignee: The Boeing Company, Chicago, IL (US)

( * ) Notice: Subject to any disclaimer, the term of this patent is extended or adjusted under 35 U.S.C. 154(b) by 168 days.

(21) Appl. No.: 15/461,561

(22) Filed: Mar. 17, 2017

(65) Prior Publication Data

US 2018/0264539 A1 Sep. 20, 2018

(51) Int. Cl.

| | |
|---|---|
| ***B21J 15/02*** | (2006.01) |
| ***B21J 15/36*** | (2006.01) |
| ***B21J 15/40*** | (2006.01) |
| ***B21J 15/04*** | (2006.01) |
| ***B21J 15/14*** | (2006.01) |

(52) U.S. Cl.

CPC ..... *B21J 15/36* (2013.01); *B21J 15/02* (2013.01); *B21J 15/04* (2013.01); *B21J 15/142* (2013.01); *B21J 15/40* (2013.01); *Y10T 29/49943* (2015.01); *Y10T 29/49956* (2015.01); *Y10T 29/5377* (2015.01)

(58) Field of Classification Search

CPC . B21J 15/02; B21J 15/046; B21J 15/06; B21J 15/105; B21J 15/142; B21J 15/36; B21J 15/40; B21J 15/048; B21J 15/24; Y10T 29/49943; Y10T 29/49956; Y10T 29/5377

See application file for complete search history.

(56) References Cited

U.S. PATENT DOCUMENTS

| | | | | |
|---|---|---|---|---|
| 2,349,341 A * | 5/1944 | Disse | B21J 15/36 | 72/466.5 |
| 2,630,030 A * | 3/1953 | Gann | B21J 15/40 | 72/456 |
| 3,391,449 A * | 7/1968 | Briles | B21J 15/02 | 29/524.1 |
| 3,562,893 A * | 2/1971 | Winslow | B21J 15/185 | 227/51 |
| 3,574,918 A * | 4/1971 | Focht | B21J 15/02 | 192/125 A |

(Continued)

FOREIGN PATENT DOCUMENTS

| | | |
|---|---|---|
| CN | 103600018 A | 2/2014 |
| CN | 104659610 A | 5/2015 |

*Primary Examiner* — Jermie E Cozart

(74) *Attorney, Agent, or Firm* — Kwan & Olynick LLP

(57) ABSTRACT

Provided are self-aligning riveting tools and methods of utilizing such tools for installing rivets. A tool includes an aligning sleeve, which is slidably coupled to a first die. Furthermore, the tool includes a die holder, which is slidably coupled to a second die. During operation, the aligning sleeve is positioned over the rivet head thereby axially aligning the first die relative to the rivet, even before the first die contacts the rivet head. The second die contacts the rivet shank end thereby axially aligning the rivet relative to the second die and the die holder. Advancing the die holder toward the first die first clamps the rivet in the tool and then proceed with forming the rivet tail. The rivet remains coaxial with both dies during all of these operations.

29 Claims, 8 Drawing Sheets

(56) References Cited

U.S. PATENT DOCUMENTS

| | | | | | |
|---|---|---|---|---|---|
| 3,747,194 | A * | 7/1973 | Christensen | B21J 15/22 | 29/243.54 |
| 3,874,070 | A * | 4/1975 | Falcioni | B21J 15/02 | 29/243.53 |
| 3,952,401 | A * | 4/1976 | Wagner | B21J 15/02 | 29/524.1 |
| 3,995,406 | A * | 12/1976 | Rosman | B21J 15/02 | 411/507 |
| 4,133,096 | A | 1/1979 | Falcioni | | |
| 4,218,911 | A * | 8/1980 | Johnston | B21J 15/36 | 72/466.4 |
| 4,493,141 | A | 1/1985 | Krezak | | |
| 4,649,733 | A * | 3/1987 | Gilmore | B21J 15/36 | 29/243.53 |
| 4,864,713 | A * | 9/1989 | Roberts | B21J 15/02 | 29/524.1 |
| 4,908,928 | A * | 3/1990 | Mazurik | B21J 15/02 | 29/243.54 |
| 4,955,119 | A * | 9/1990 | Bonomi | B21J 15/10 | 227/58 |
| 5,042,137 | A * | 8/1991 | Speller, Sr. | B21J 15/10 | 29/524.1 |
| 5,222,289 | A * | 6/1993 | Michalewski | B21J 15/02 | 29/524.1 |
| 6,219,898 | B1 * | 4/2001 | Kubanek | B21J 15/02 | 29/34 B |
| 2008/0233779 | A1 * | 9/2008 | Gibellini | B21J 9/022 | 439/202 |
| 2014/0157858 | A1 * | 6/2014 | Mann | B21J 15/36 | 72/481.3 |

* cited by examiner

SELF-ALIGNING RIVETING METHOD

FIELD

This disclosure relates to self-aligning riveting tools and methods of installing rivets using such self-aligning riveting tools.

BACKGROUND

Rivets may be used for various fastening applications, such as attaching aircraft skin to aircraft frame components, various interior structures of aircraft, and the like. Rivets are widely used and tend to be one of the lightest and least expensive methods of fastening structural components together. However, inserting rivets and buckling/upsetting their shank ends (to form rivet tails) can be a very labor intensive process and can require highly skilled operators. One processing aspect that can be particularly challenging is aligning two dies of a riveting tool relative to the rivet. During riveting operation, one die supports the rivet head, while the other die forms the rivet tail. Both dies and the rivet need to be strictly coaxial to ensure proper formation of the rivet tail. This alignment difficulty drives up the cost of riveting joints and tend to offset the inherent low cost of riveting materials. Quality of riveted joints depends on the die-rivet alignment. Self-aligning riveting tools and methods of installing rivets using such self-aligning riveting tools are needed to reduce labor intensity and ensure consistent die-rivet alignments.

SUMMARY

Provided are self-aligning riveting tools and methods of utilizing such tools for installing rivets. A tool includes an aligning sleeve, which is slidably coupled to a first die. Furthermore, the tool includes a die holder, which is slidably coupled to a second die. During operation, the aligning sleeve is positioned over the rivet head thereby axially aligning the first die relative to the rivet, even before the first die contacts the rivet head. The second die contacts the rivet shank end thereby axially aligning the rivet relative to the second die and the die holder. Advancing the die holder toward the first die first clamps the rivet in the tool and then proceed with forming the rivet tail. The rivet remains coaxial with both dies during all of these operations.

In some embodiments, a method of installing a rivet for coupling a first part and a second part using a self-aligning riveting tool, the method comprises positioning an aligning sleeve of the self-aligning riveting tool over a rivet head. The rivet head protrudes from a first part or, more specifically, above the outside surface of the first part. The aligning sleeve is slidably coupled to a first die of the self-aligning riveting tool. Furthermore, the aligning sleeve maintains the concentric orientation of the first die relative to the rivet. In other words, the aligning sleeve prevents the first die from moving relative to the rivet in any direction perpendicular to the center axis of the self-aligning riveting tool. This concentric orientation may be maintained throughout subsequent operations of the method until, for example, the rivet tail is formed. For example, the first die and the rivet may be coaxial.

The method also comprises contacting a shank end of the rivet with a second die of the self-aligning riveting tool. The second die is slidably coupled to a die holder of the self-aligning riveting tool. Furthermore, the second die maintains the concentric orientation of the die holder relative to the rivet. In other words, the second die does not move relative to the rivet in any direction perpendicular to the center axis of the self-aligning riveting tool. This concentric orientation may be maintained throughout subsequent operations of the method until, for example, the rivet tail is formed. For example, the second die and the rivet may be coaxial. Contacting the shank end with the second die may be performed before, after, or while positioning the aligning sleeve over the rivet head.

Once the shank end contacts the second die and the aligning sleeve is positioned over the rivet head, the method may proceed with advancing the first die toward the die holder. This advancement operation may be performed until the rivet head contacts the first die and, also, until the die holder contacts an inner contact surface of the second die. At this stage, the rivet is clamped between the first die and the die holder, which are externally supported. It should be noted that the first die directly contacts the rivet, while a portion of the second die is positioned between the die holder and the rivet.

The method then proceed with forming a rivet tail of the rivet at the shank end. The forming operation may also involve advancing the first die toward the die holder and upsetting the shank end with the second die. It should be noted that during this operation, the movement of the die holder toward the first die also causes the movement of the second die in the same direction. The limit for this advancement may be set by the self-aligning riveting tool, e.g., available travel of the first die relative to the die holder.

In some embodiments, positioning the aligning sleeve over the first head comprises engaging the circumferential edge of the rivet head with the aligning sleeve. Specifically, the aligning sleeve may be tightly fit over the rivet head and may contact the circumferential edge of the rivet head. After positioning the aligning sleeve of the self-aligning riveting tool over the rivet head of the rivet, the first die and the rivet may be coaxial. At least, the first die and the rivet cannot move concentricly with respect to each other.

Furthermore, positioning the aligning sleeve over the rivet head comprises biasing the aligning sleeve toward the first part and relative to the first die. This biasing operation may involve biasing the first die away from the rivet head. Specifically, after positioning the aligning sleeve over the first head, and prior to advancing the first die toward the die holder, the first die may be positioned away from the rivet head.

Biasing the aligning sleeve toward the first part and relative to the first die may be performed using a first biasing device disposed over the first die, such that at least a portion of the first die protrudes through the first biasing device. Specifically, the first biasing device may be a spring.

In some embodiments, contacting the shank end with the second die comprises biasing the second die toward the shank end and relative to the die holder. Specifically, biasing the second die toward the shank end and relative to the die holder may be performed using a second biasing device disposed inside the second die. In some embodiments, the die holder at least partially protrudes through the second biasing device. The second biasing device may be a spring.

In some embodiments, biasing the second die toward the shank end and relative to the die holder comprises biasing the die holder away from the inner contact surface of the second die. Specifically, after contacting the shank end with the second die, and prior to advancing the first die toward the die holder, the die holder may be positioned away from the inner contact surface of the second die.

In some embodiments, contacting the shank end with the second die comprises protruding the aligning portion of the second die into the opening at the shank end. For example, the aligning portion may have a cone-shape, a sphere-shape, or the like such that the aligning portion and the opening are coaxial after contacting the shank end with the second die.

In some embodiments, advancing the first die toward the die holder comprises sliding the first die relative to the aligning sleeve along the center axis of the self-aligning riveting tool. Furthermore, advancing the first die toward the die holder comprises sliding the die holder relative to the second die along a center axis. Sliding the first die relative to the aligning sleeve may overlap in time with sliding the die holder relative to the second die.

In some embodiments, advancing the first die toward the die holder comprises maintaining contact between the aligning sleeve and the first part. More specifically, the aligning sleeve remains positioned over the rivet head of the rivet. As such, the aligning sleeve, the first die, and the rivet may remain coaxial. Furthermore, advancing the first die toward the die holder comprises maintaining the contact between the second die and the shank end.

In some embodiments, forming the rivet tail comprises advancing the second die toward the second part. The shank end is upset, as a result of this movement, and the rivet tail is formed. The aligning sleeve remains positioned over the rivet head of the rivet during this operation. Therefore, the rivet and the first die remain coaxial.

In some embodiments, the method further comprises measuring a combined thickness of the first part and the second part, and selecting the rivet based, at least in part, on this combined thickness. The method may further comprise selecting the self-aligning riveting tool based, at least in part, on the combined thickness. For example, the lengths of the first die, the die holder, and a portion of the second die extending past the die holder may be considered in light of the combined thickness.

In some embodiments, selecting the self-aligning riveting tool based on the combined thickness comprises selecting the second die and the die holder based, at least in part, on the combined thickness. For example, selecting the self-aligning riveting tool based on the combined thickness comprises adjusting a slidable distance between the second die and the die holder based on the combined thickness.

Provided also is a self-aligning riveting tool for installing a rivet. The self-aligning riveting tool may comprise a first die, an aligning sleeve, a second die, and a die holder. The aligning sleeve is slidably coupled to the first die. The first die may at least partially protrude through the aligning sleeve. The aligning sleeve may be operable to position over a rivet head of the rivet and to maintain concentric orientation of the first die relative to the rivet. The second die may be operable to form a rivet tail of the rivet, which is at a shank end of the rivet. The die holder may be slidably coupled to the second die. Furthermore, the die holder may at least partially protrude into the second die. The slidable distance between the die holder and the second die may be adjustable.

In some embodiments, the self-aligning riveting tool further comprises a first biasing device, which may bias the aligning sleeve relative to the first die along the center axis. The self-aligning riveting tool may also comprise a second biasing device, which may bias the die holder relative to the second die along the center axis. The second biasing device may be disposed inside the second die.

The features and functions that have been discussed can be achieved independently in various examples or may be combined in yet other examples further details of which can be seen with reference to the following description and drawings.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific examples, it will be understood that these examples are not intended to be limiting.

Figure 1:
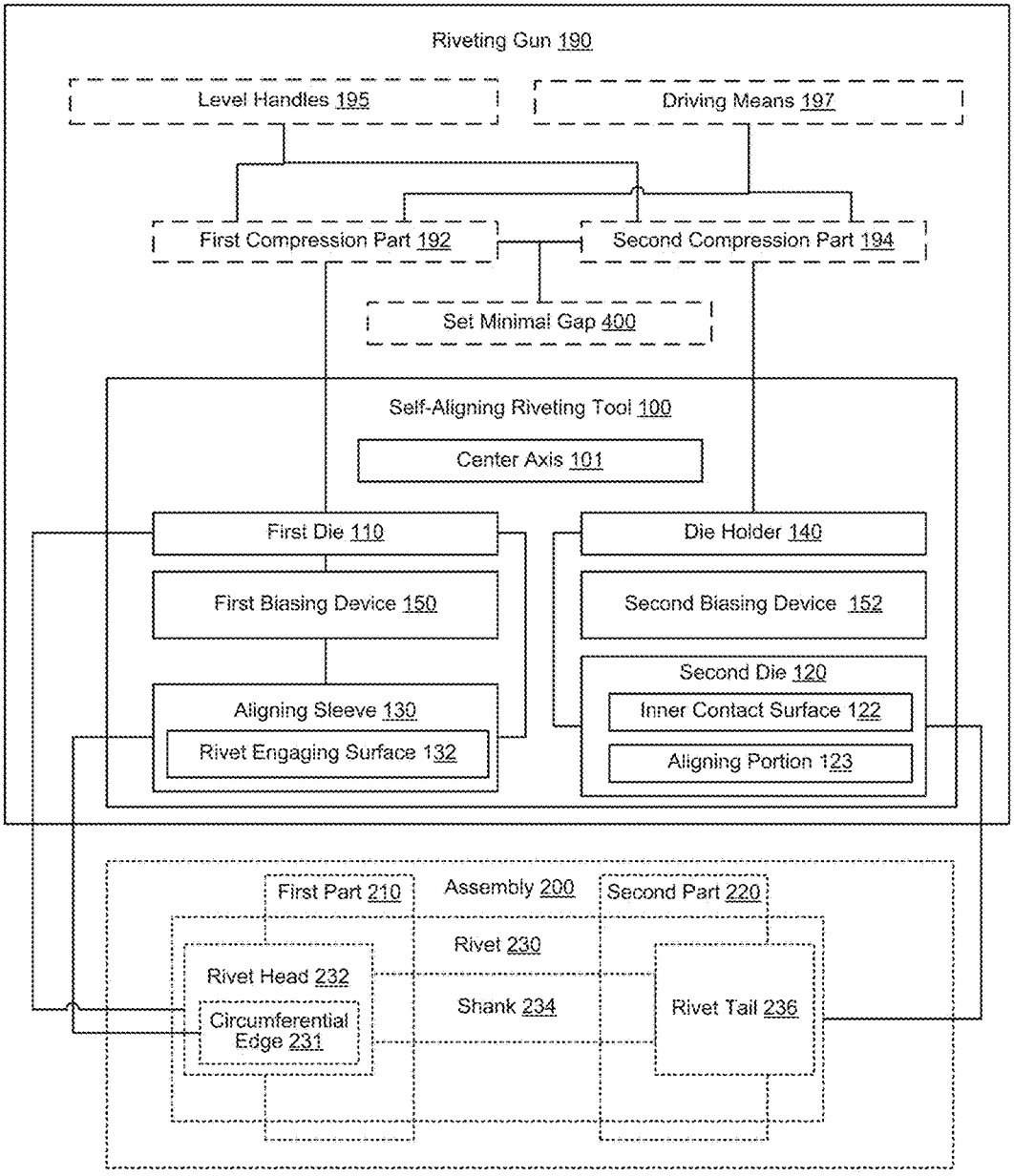
FIG. 1 is a schematic block diagram of a self-aligning riveting tool, which may be a part of a press, in accordance with some examples.

In FIG. 1, solid lines, if any, connecting various elements and/or components may represent mechanical, electrical, fluid, optical, electromagnetic and other couplings and/or combinations thereof. As used herein, "coupled" means associated directly as well as indirectly. It will be understood that not all relationships among the various disclosed elements are necessarily represented. Accordingly, couplings other than those depicted in the block diagrams may also exist. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

INTRODUCTION

As stated above, rivets may be used for various fastening applications. Rivets are often installed using a riveting gun, one example of which is schematically presented in FIG. 1. Riveting gun 190 may comprise two compression parts 192 and 194 coupled to self-aligning riveting tool 100. Compression parts 192 and 194 are operable to drive components of self-aligning riveting tool 100, such as die holder 140 and first die 110, along center axis 101 of self-aligning riveting tool 100. Riveting gun 190 may be manually operated (e.g., have lever handles 195) or may be operated using driving means 197, e.g., pneumatic, hydraulic, electrical, or mechanical means. In some example, riveting gun 190 is a press.

Figure 4B:
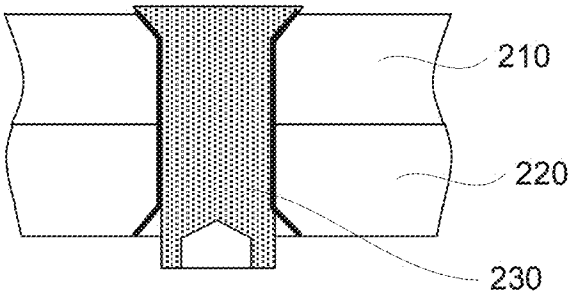
FIGS. 4A-4E are schematic representations of different stages of the method of FIG. 3, in accordance with some examples.
Figure 4A:
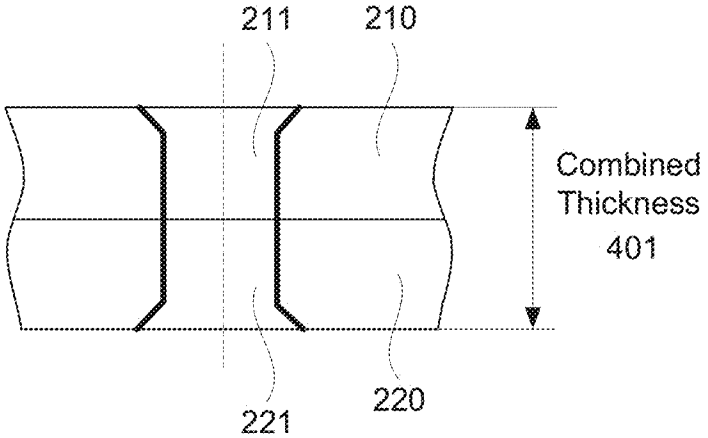
Figure 4E:
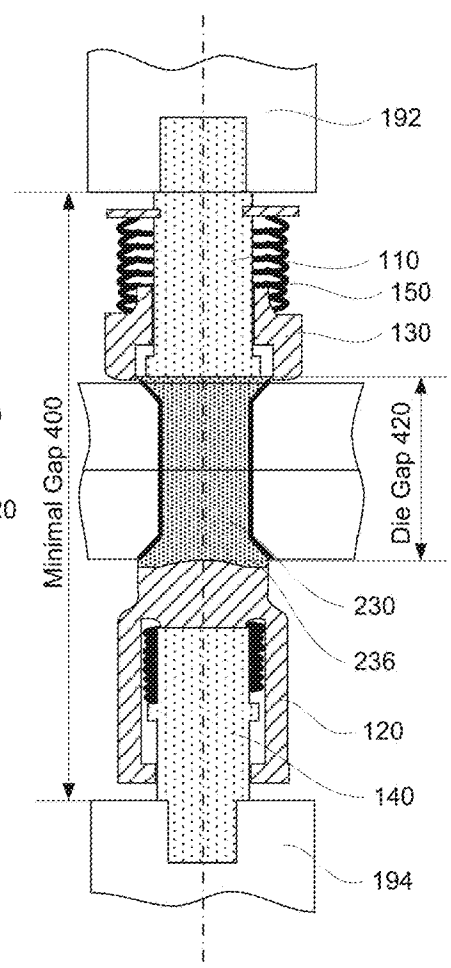

In some embodiments, riveting gun 190 has set minimal gap 400 between two compression parts 192 and 194 as, for example schematically shown in FIG. 4E. The set minimal gap is defined as a distance between compression parts 192 and 194 when compression parts 192 and 194 are in their closest respective positions. In other words, compression parts 192 and 194 cannot be brought closer together that the set minimal gap 400.

Set minimal gap 400 of riveting gun 190 may be used, at least in part, to determine the length of rivets 230 that can be installed using riveting gun 190. Another factor is the design of self-aligning riveting tool 100, as further described below. It should be noted that self-aligning riveting tool 100 or components thereof may be replaced to accommodate different rivet lengths (for the same set minimal gap 400 between two compression parts 192 and 194). For example, the length of rivets 230 may be used as an independent variable to select a particular design or configuration of self-aligning riveting tool 100. Specifically, the difference between the length of the formed rivet and the same set minimal gap between two compression parts 192 and 194 is occupied by various components of self-aligning riveting tool 100. These components are specifically selected to accommodate the difference in height/gap without a need for shims and trial-error riveting, which are both may be present in conventional riveting tools and processes. Specifically, a conventional riveting process involves aligning a riveting gun and the rivet using a small protrusion on the rivet die and an indent on the rivet head, which requires a skillful operator. If the die protrusion is not aligned with the rivet indent, the installation is non-conforming and requires rework.

Self-aligning riveting tool 100 addresses the above-mentioned problems associated with conventional riveting tools and processes and allows the operator to quickly center self-aligning riveting tool 100 relative to rivet 230. Specifically, aligning sleeve 130 is positioned over the existing rivet head thereby aligning rivet 230 with first die 110. Furthermore, second die 120 comes into contact with rivet 230 or more specifically, aligning portion 123 of second die 120 at least partially protrudes into end opening 237 of shank end 235. This feature ensures alignment of rivet 230 and second die 120. It would be noted that at this stage, rivet 230 may be still realigning relative to self-aligning riveting tool 100 either by retracting second die 120 and/or aligning sleeve 130 or overcoming biasing forces operable on second die 120 and aligning sleeve 130. While these biasing forces are sufficient to maintain contacts between rivet 230 and second die 120 as well as aligning sleeve 130, rivet 230 is not rigidly clamped between these components and realignment is still possible. As such, the alignment is achieved within substantial efforts from the operator, thereby saving time, reducing defects, and improving quality. The process continues with clamping the rivet and eventually forming the rivet tail.

Self-Aligning Riveting Tool Examples

Figure 2A:
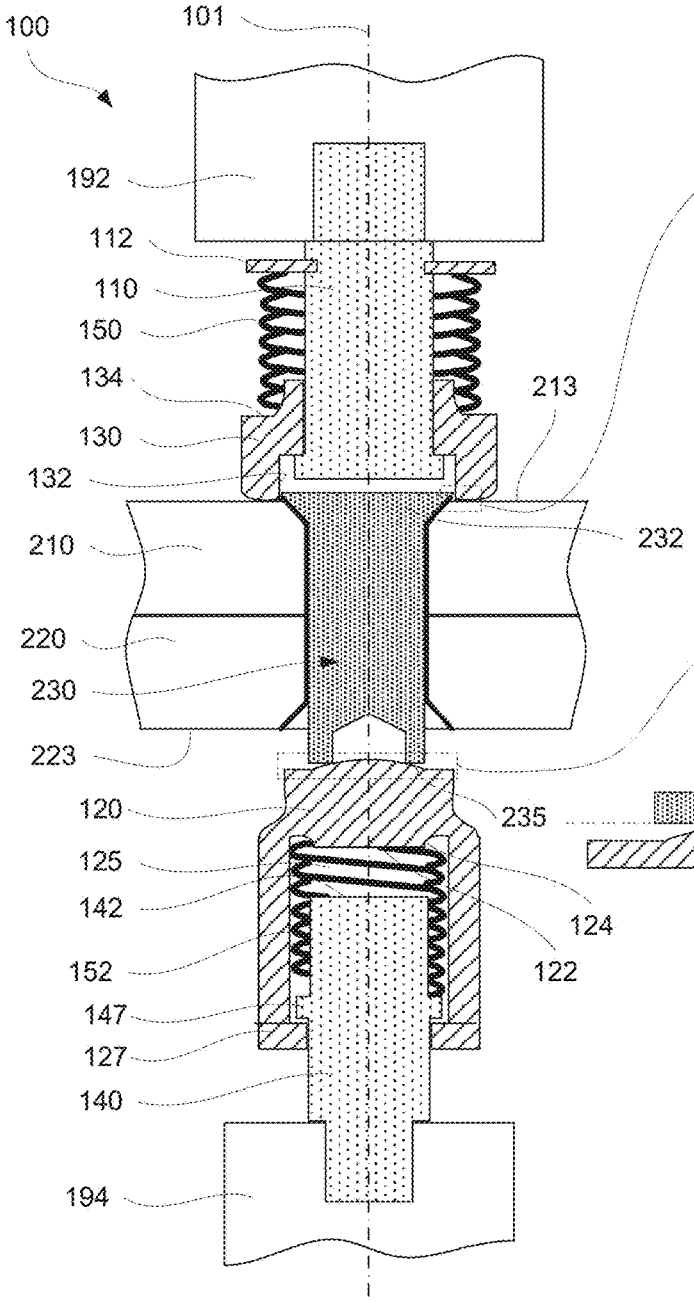
FIG. 2A is a schematic representation of a self-aligning riveting tool engaging a rivet, in accordance with some examples.

FIG. 2A is a schematic illustration of self-aligning riveting tool 100, in accordance with some examples. Self-aligning riveting tool 100 comprises first die 110, aligning sleeve 130, second die 120, and die holder 140. In some embodiments, self-aligning riveting tool 100 further comprises first biasing device 150 and/or second biasing device 152. Each of these components of self-aligning riveting tool 100 will now be described in more detail.

Aligning sleeve 130 is slidably coupled to first die 110 such that aligning sleeve 130 and first die 110 may slide relative to each other along center axis 101 of self-aligning riveting tool 100. This slidable feature allows aligning sleeve 130 to be positioned over rivet head 232 and align first die 110 relative to rivet 230 before first die 110 comes in contacts with rivet head 232. As first die 110 advances toward rivet head 232, the alignment between first die 110 and rivet 230 is maintained, which substantially simplifies operations of self-aligning riveting tool 100. The operator is relieved from maintaining the alignment between first die 110 and rivet 230 after aligning sleeve 130 is positioned over rivet head 232. Specifically, aligning sleeve 130 maintains the concentric orientation of first die 110 relative to rivet 230 during any operations while aligning sleeve 130 remains positioned over rivet head 232.

In some examples (e.g., as shown in FIG. 2A), when aligning sleeve 130 is positioned over rivet head 232, aligning sleeve 130 establishes the coaxial orientation of first die 110 and rivet 230. Specifically, aligning sleeve 130 may be coaxial relative to first die 110. Aligning sleeve 130 may become coaxial relative to rivet 230 when aligning sleeve 130 engages rivet head 232.

Figure 2B:
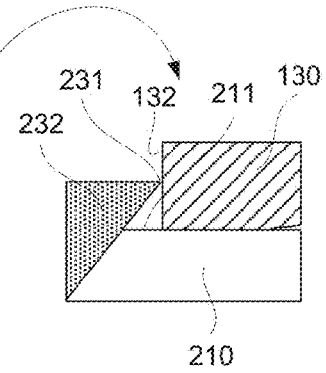
FIG. 2B is a schematic expanded representation of an aligning sleeve of the self-aligning riveting tool of FIG. 2A engaging the rivet, in accordance with some examples.

As shown in FIGS. 2A and 2B, aligning sleeve 130 comprises rivet engagement surface 132 defining at least a portion of the interior of aligning sleeve 130. Rivet engagement surface 132 contacts a portion of rivet head 232 protruding above first part 210 or, more specifically, above outside surface 213 of first part 210. For purposes of this disclosure, outside surface 213 is defined as a surface of first part 210 that faces away from second part 220. More specifically, rivet engagement surface 132 engages circumferential edge 231 of rivet head 232 as, for example, schematically shown in FIG. 2B. However, other forms of engagement are also within the scope. Rivet engagement surface 132 may have a cylindrical, conical, spherical, or other suitable shape.

First die 110 may at least partially protrude through aligning sleeve 130 as, for example, schematically shown in FIG. 2A. A portion of first die 110 may extend outside of aligning sleeve 130 to engage with another component of riveting gun, such as first compression part 190. During operation of self-aligning riveting tool 100, first compression part 190 exerts forces on first die 110 causing it to move relative to aligning sleeve 130 and later to (support rivet head 232 rivet tail—not sure that rivet head 232 rivet tail makes sense. Please adjust globally where applicable). First die 110 may be decoupled from first compression part 190. For example, first dies 110 having different lengths may be used with the same first compression part 190. Different first dies 110 may be used, for example, to accommodate rivets 230 having different lengths.

In some embodiments, self-aligning riveting tool 100 further comprises first biasing device 150, which may bias aligning sleeve 130 relative to first die 110 along center axis 101. Specifically, first biasing device 150 may bias first die 110 away from rivet 230. Likewise, first biasing device 150 may bias aligning sleeve 130 away from first compression part 190 supporting first die 110.

First biasing device 150 maybe a spring or, more specifically, a coil spring. Other types of biasing devices are also within the scope. In some embodiments, at least a portion of first die 110 protrudes through first biasing device 150. First biasing device 150 may extend between concentric protrusion 112 of first die 110 and outer rim 134 of aligning sleeve 130. As shown in FIG. 2A, a portion of aligning sleeve 130 may protrude into first biasing device 150.

Second die 120 is slidably coupled and supported by die holder 140. Die holder 140 in turn is supported by second compression part 195 as, for example, shown in FIG. 2A. Second die 120 does not directly engage any parts of riveting gun.

Second die 120 may slide relative to die holder 140 along center axis 101. In some embodiments, die holder 140 at least partially protrude into second die 120. As, die holder 140 slides inside second die 120, holder contact surface 142 may contact inner contact surface 122 of second die 120, which acts as a positive stop for this sliding motion, which may be referred to as compressive sliding. Inner contact surface 122 may be a part of inner axial protrusion 124 extending within cavity 125 of second die 120. Another positive stop for the axial movement of die holder 140 relative to second die 120 may be provided by radially protruding collar 127 of second die 120 and radially protruding notch 147 of die holder 140. As shown in FIG. 2A, a combination of collar 127 and notch 147 prevent die holder 140 from sliding completely out of second die 120.

Figure 4D:
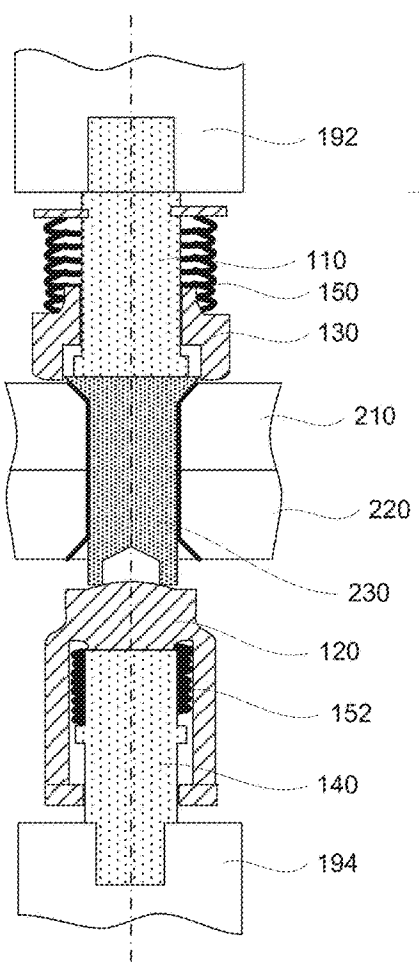

Inner contact surface 122 may be perpendicular to center axis 101. Likewise, holder contact surface 142 may be also perpendicular to center axis 101. These perpendicular features permit concentric alignment of second die 120 and die holder 140 when inner contact surface 122 contacts holder contact surface 142 of holder 140 as, for example, shown in FIGS. 4D and 4E. When holder contact surface 142 contacts inner contact surface 122 and when die holder 140 is further advanced toward first die 110, die holder 140 will cause second die 120 to move in the same direction and at the same rate.

Figure 2C:
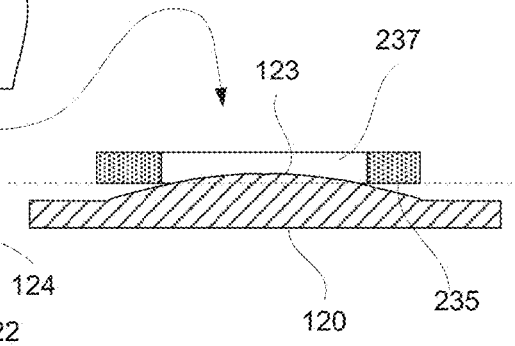
FIG. 2C is a schematic expanded representation of a second die of the self-aligning riveting tool of FIG. 2A engaging the rivet, in accordance with some examples.
Figure 2D:
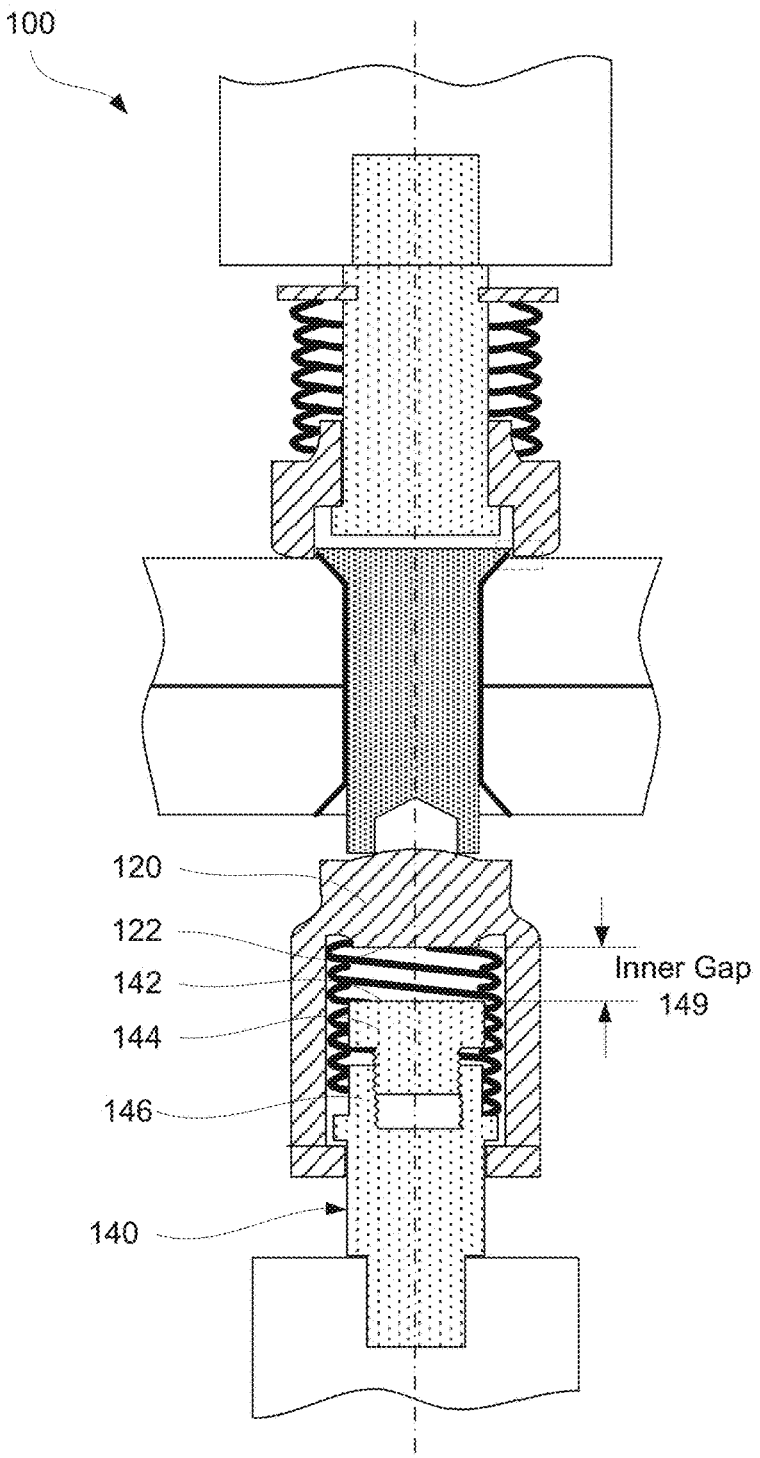
FIG. 2D is a schematic representation of another example of a self-aligning riveting tool engaging a rivet.

In some embodiments, slidable distance 402 between die holder 140 and second die 120 may be adjustable as, for example, shown in FIG. 2D. Specifically, the length of die holder 140 may be adjustable (as shown in FIG. 2D) or the length an interior cavity of second die 120 may be adjustable. As shown in FIG. 2D, die holder 140 may have two portions 144 and 146 threadably coupled with respect to each and operable to change inner gap 149 between inner contact surface 122 and holder contact surface 142. Furthermore, a similar adjustment may be achieved by removing and replacing second die 120 and/or die holder 140.

Second die 120 may be operable to form rivet tail 236 of rivet 230 at shank end 235 as further described below with reference to FIGS. 3 and 4E. Second die 120 may comprise aligning portion 123 for protruding into opening 237 at shank end 235. A combination of aligning portion 123 and shank opening 237, when engaged, coaxially aligns second die 120 relative to rivet 230 as, for example, schematically shown in FIG. 2C. It should be noted that shank end 235 is upset during riveting and formed into rivet tail 236. Aligning portion 123 may, at least in part, define the shape of rivet tail 236.

In some embodiments, self-aligning riveting tool 100 comprises second biasing device 152. Second biasing device 152 may bias die holder 140 relative to second die 120 along center axis 101. Second biasing device 152 may be disposed inside second die 120.

First biasing device 150 and second biasing device 152 may be used for concentric alignment of aligning sleeve 130 and second die 120, respectively, relative to rivet 230.

Examples of Methods

Figure 3:
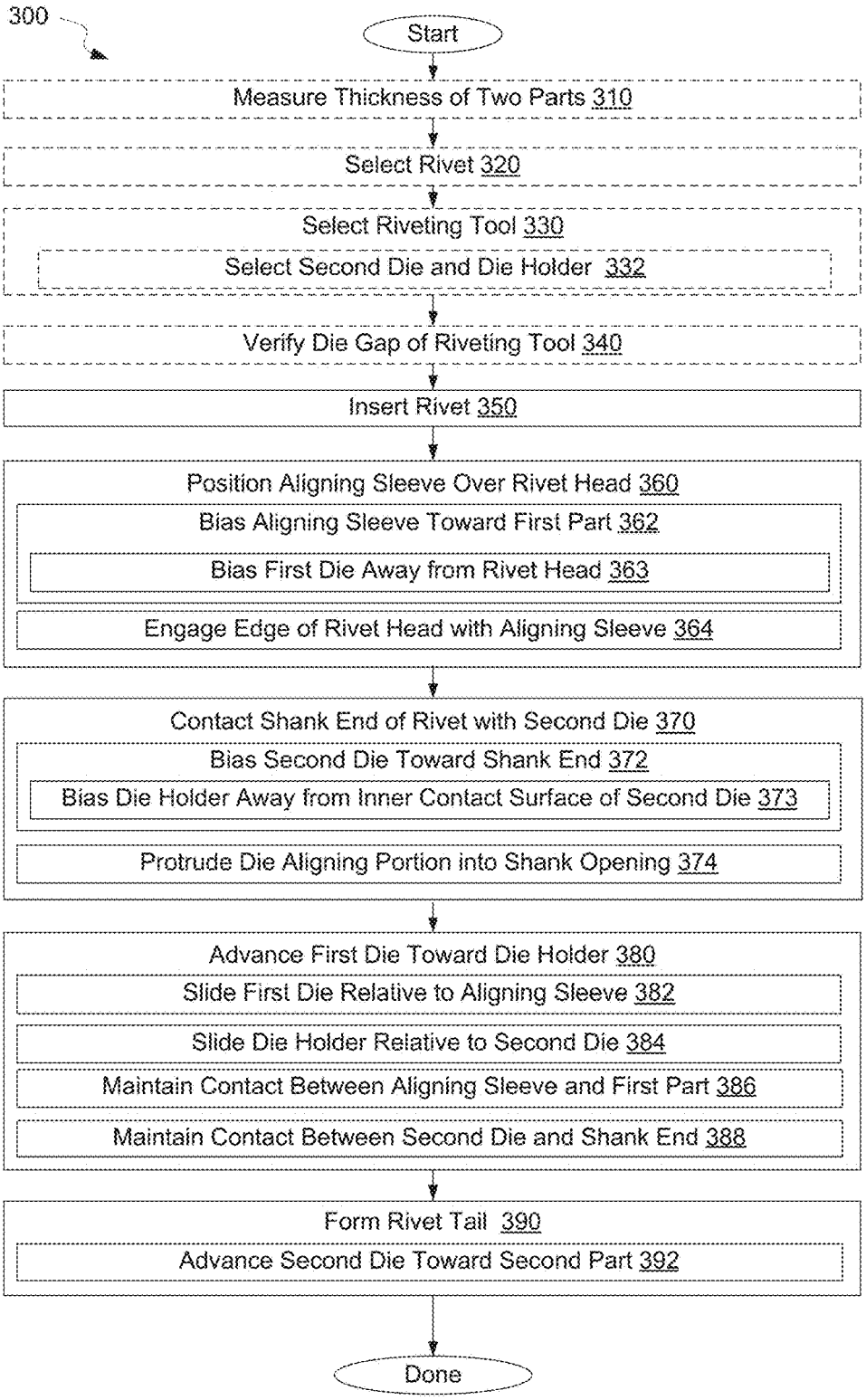
FIG. 3 is a process flowchart corresponding to a method of installing a rivet using a self-aligning riveting tool, in accordance with some examples.

FIG. 3 is a process flowchart corresponding to method 300 of installing rivet 230 for coupling first part 210 and second part 220 using self-aligning riveting tool 100, in accordance with some examples. Various features of self-aligning riveting tool 100 are described above. Various types of rivets 230 may be used, such as tubular rivets and solid rivets. Tubular rivets have opening 237 at shank end 235 as shown in FIGS. 2A and 2B. Opening 237 may be used to reduce the amount of force needed for upsetting shank end (e.g., rolling the tubular portion outward). For example, this force may be between about 10-30% for a tubular rivet in comparison to a similarly-sized solid rivet.

In some embodiments, method 300 comprises measuring combined thickness 401 of first part 210 and second part 220 during optional operation 310. For example, method 300 may be performed in new types of first part 210 and second part 220 that have not been riveted before. Combined thickness 401 of first part 210 and second part 220 is schematically illustrated in FIG. 4A. It should be noted that combined thickness 401 is measured or should be representative of the thickness near first through opening 211 (in first part 210) and second through opening 221 (in second part 220). First through opening 211 and second through opening 221 may be coaxially aligned during this operation. Combined thickness 401 drives the length of rivet 230 that would be needed to secure first part 210 relative to second part 220. While FIG. 4A illustrates countersinks provided in both parts 210 and 220, other examples (e.g., with one countersink or no countersinks) are also within the scope.

Method 300 may proceed with selecting rivet 230 (for securing first part 210 relative to second part 220) during optional operation 320. Rivet 230 may be selected based, at least in part, on combined thickness 401.

Method 300 may further comprise selecting self-aligning riveting tool 100 during optional operation 330. Self-aligning riveting tool 100 may be selected based, at least in part, on combined thickness 410 and/or the length of rivet 230. Specifically, the gap between first die 110 and second die 120 (when inner contact surface 122 of second die contacts die holder 140 and when compression parts 190 and 195 are at their minimum set gap) should correct to the length of rivet 230 in order to achieve proper upset of shank end 235 and forming rivet tail 236. The rivet squeeze size, which is the length of rivet 230 after complete squeeze, for some rivets may be controlled within a tight tolerance. For example, if the length of rivet 230 selected during operation 330 is 0.500 inches (derived from the combined thickness), then the squeeze size should fall between 0.450 inches and 0.455 inches, in some examples.

In some embodiments, operation 330 (selecting self-aligning riveting tool 100 based on combined thickness 410) comprises selecting second die 120 and die holder 140 during optional operation 332. For example, second die 120 and die holder 140 may be selected based, at least in part, on combined thickness 410. In some embodiments, operation 330 adjusting slidable distance 402 (shown in FIG. 4C) between second die 120 and die holder 140 based on combined thickness 401. Adjustment of slidable distance 402 may be used to accommodate different lengths of rivets using the same rivet gun 190, which has a set minimal gap 400 and travel to achieve this minimal gap 400.

Method 300 may further comprise verifying the die gap 420 of self-aligning riveting tool 100 during optional operation 340. It should be noted that during this operation, inner contact surface 122 of second die 120 contacts holder contact surface 142 of die holder 140 and compression parts 190 and 195 are at their minimum set gap 400.

Method 300 may further comprise inserting rivet 230 into first through opening 211 (in first part 210) and second through opening 221 (in second part 220) during operation 350. An assembly including first part 210, second part 220, and rivet 230 after completing operation 350 is shown in FIG. 4B.

Figure 4C:
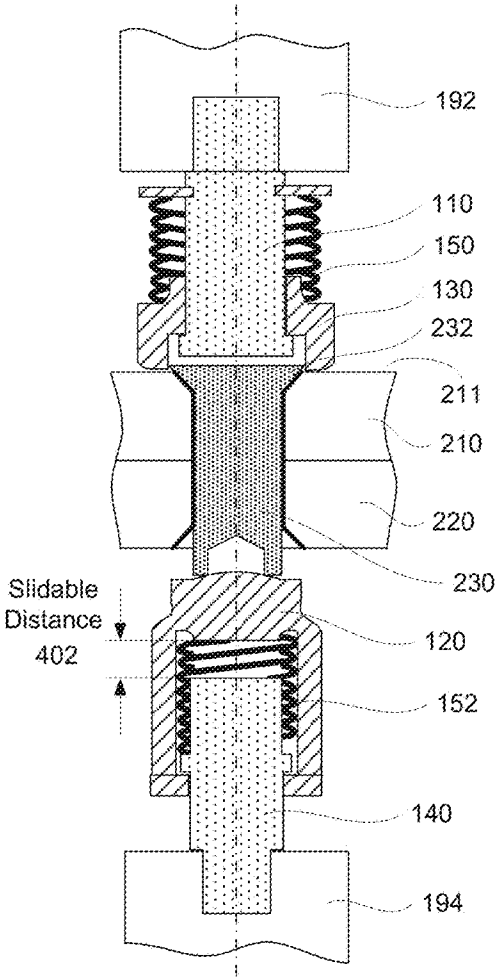

Method 300 may comprise positioning aligning sleeve 130 of self-aligning riveting tool 100 over rivet head 232 of rivet 230 during operation 360, as schematically shown in FIG. 4C as well as FIGS. 2A and 2B. Rivet head 232 protrudes from first part 210 or, more specifically, above outside surface 213 of first part 210. Once operation 360 is completed, aligning sleeve 130 maintains concentric orientation of first die 110 relative to rivet 230. In other words, aligning sleeve 130 prevents first die 110 from moving relative to rivet 230 in any direction perpendicular to center axis 101 of self-aligning riveting tool 100.

Furthermore, operation 360 (positioning aligning sleeve 130 over rivet head 232) may comprise biasing aligning sleeve 130 toward first part 210 and relative to first die 100 as schematically shown by block 362 in FIG. 3. Biasing operation 362 may involve biasing first die 110 away from rivet head 232 as schematically shown by block 363 in FIG. 3. Specifically, after positioning aligning sleeve 130 over first head 232, and prior to advancing first die 110 toward die holder 140, first die 110 is positioned away from rivet head 232. Biasing aligning sleeve 130 toward first part 210 and relative to first die 110 may be performed using first biasing device 150 disposed over first die 110 such that first die 110 protrudes through first biasing device 150.

In some embodiments, operation 360 (positioning aligning sleeve 130 over first head 232) comprises engaging circumferential edge 231 of rivet head 232 with aligning sleeve 130 as schematically shown by block 364 in FIG. 3. Aligning sleeve 130 may be tightly fit over rivet head 232 and may contact circumferential edge 231 of rivet head 232 with aligning sleeve 130. After positioning aligning sleeve 130 of self-aligning riveting tool 100 over rivet head 232 of rivet 230, first die 110 and rivet 230 are coaxial.

Method 300 also comprises contacting shank end 235 of rivet 230 with second die 120 of self-aligning riveting tool 100 as schematically shown by block 370 in FIG. 3. Self-aligning riveting tool 100 (after completing operation 370) is schematically shown in FIG. 4C as well as FIGS. 2A and 2C. Shank end 235 protrudes from second part 220 or, more specifically, below outside surface 223 of second part 220. Second die 120 maintains concentric orientation of die holder 140 relative to rivet 230. Operation 370 may be performed before, after, or while performing operation 360.

In some embodiments, contacting shank end 235 with second die 120 during operation 370 comprises biasing second die 120 toward shank end 235 and relative to die holder 140 as schematically shown by block 372 in FIG. 3. Specifically, biasing second die 120 toward shank end 235 and relative to die holder 140 may be performed using a second biasing device 152 disposed inside second die 120.

In some embodiments, biasing second die 120 toward shank end 235 and relative to die holder 140 comprises biasing die holder 140 away from an inner contact surface 122 of second die 120 as schematically shown by block 373 in FIG. 3. Specifically, after contacting shank end 235 with second die 120, and prior to advancing first die 110 toward die holder 140, die holder 140 may be positioned away from inner contact surface 122 of second die 120.

In some embodiments, contacting shank end 235 with second die 120 comprises protruding aligning portion 123 of second die 120 into an opening 237 at shank end 235 as schematically shown by block 374 in FIG. 3. One example of aligning portion 123 protruding into shank end 235 is presented in FIG. 2C and described above with reference to this figure.

After completing operations 360 and 370 (e.g., once shank end 235 contacts second die 120 and aligning sleeve 130 is positioned over rivet head 232), method 300 may proceed with advancing first die 110 toward die holder 140 during operation 380. Operation 380 may be performed until rivet head 232 contacts first die 110 and, also, until die holder 140 contacts an inner contact surface 122 of second die 120 as, for example, schematically shown in FIG. 4D. The control limit for this advancement operation 380 may be a set force. Specifically, the force needed for this advancement operation 380 may be a lot smaller than for a later operation, when a rivet tail 236 is formed.

In some embodiments, advancing first die 110 toward die holder 140 during operation 380 comprises sliding first die 110 relative to aligning sleeve 130 along center axis 101 of self-aligning riveting tool 100 as schematically shown by block 382 in FIG. 3. Furthermore, advancing first die 110 toward die holder 140 comprises sliding die holder 140 relative to second die 120 along a center axis 101 as schematically shown by block 384 in FIG. 3. Sliding first die 110 relative to aligning sleeve 130 may overlap in time with sliding die holder 140 relative to second die 120.

In some embodiments, advancing first die 110 toward die holder 140 during operation 380 comprises maintaining contact between aligning sleeve 130 and first part 210 as schematically shown by block 386 in FIG. 3. More specifically, aligning sleeve 130 remains positioned over rivet head 232 of rivet 230. Furthermore, advancing first die 110 toward die holder 140 comprises maintaining contact between second die 120 and shank end 235 as schematically shown by block 388 in FIG. 3.

Method 300 may then proceed with forming rivet tail 236 of rivet 230 at shank end 235 during operation 390. In some embodiments, forming rivet tail 236 comprises advancing second die 120 toward second part 220 as schematically shown by block 392 in FIG. 3. The limit for this advancement may be set by self-aligning riveting tool 100, e.g., available travel of first die 110 relative to die holder 140. Aligning sleeve 130 may remain positioned over rivet head 232 of rivet 230 during this operation. Therefore, rivet 230 and first die 110 remain coaxial. Specifically, the compression of rivet 230 during formation of rivet tail 236 also results in shank end 235 expanding concentricly to contact/interfere with surface 223 of second part 220 as, for example, schematically shown in FIG. 4E. At this point, rivet 230 receives rivet tail 236. First part 210 and second part 220 are compressed between rivet head 232 and rivet tail 236.

After forming rivet tail 236, first compression part 192 and second compression part 194 may be separated to the point at which aligning sleeve 130 is removed from rivet head 232, while second die 120 is separated from rivet tail 236. Operations of method 300 may be repeated with another rivet.

Examples of Aircrafts

Figure 5:
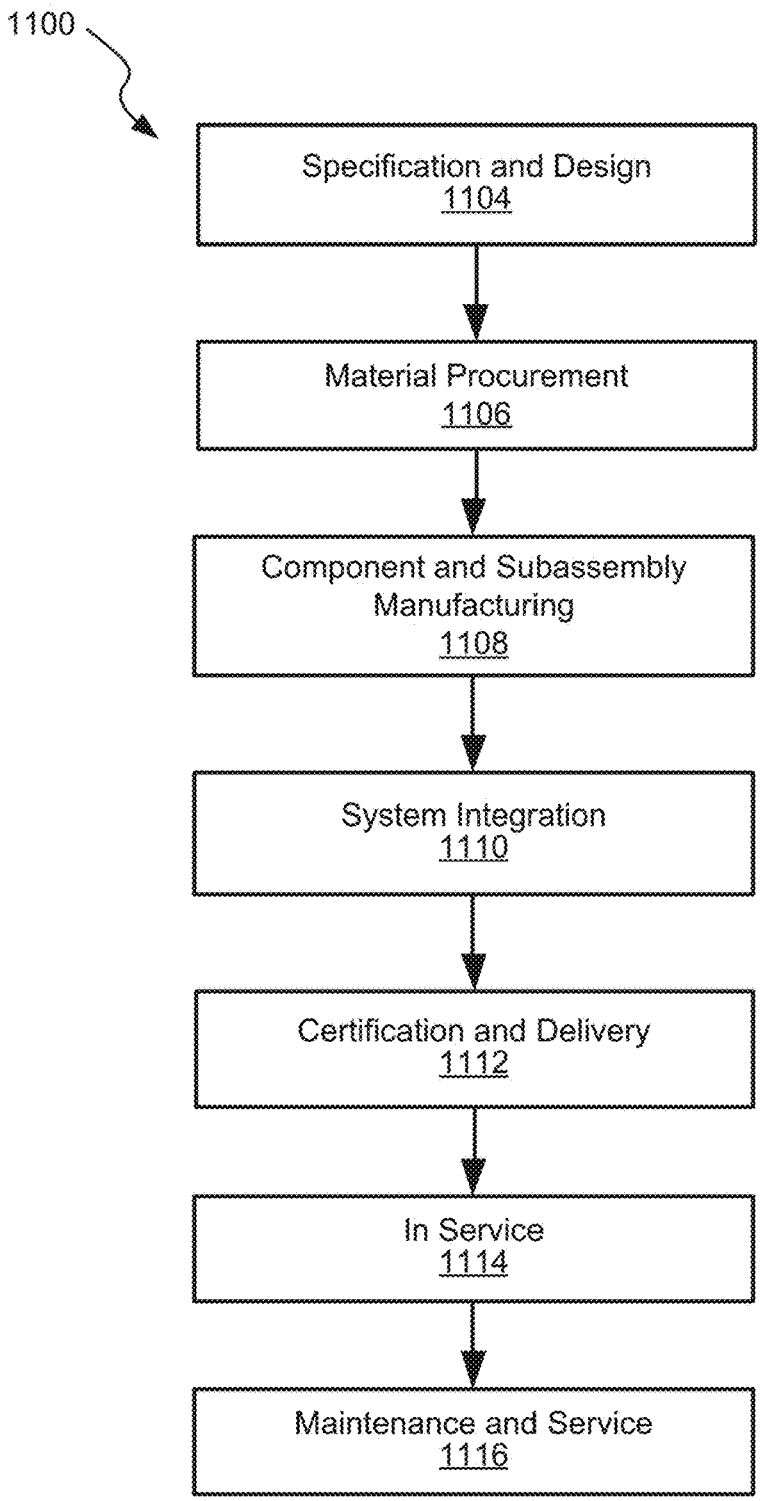
FIG. 5 is a process flowchart reflecting key operations in aircraft manufacturing and service, in accordance with some examples.
Figure 6:
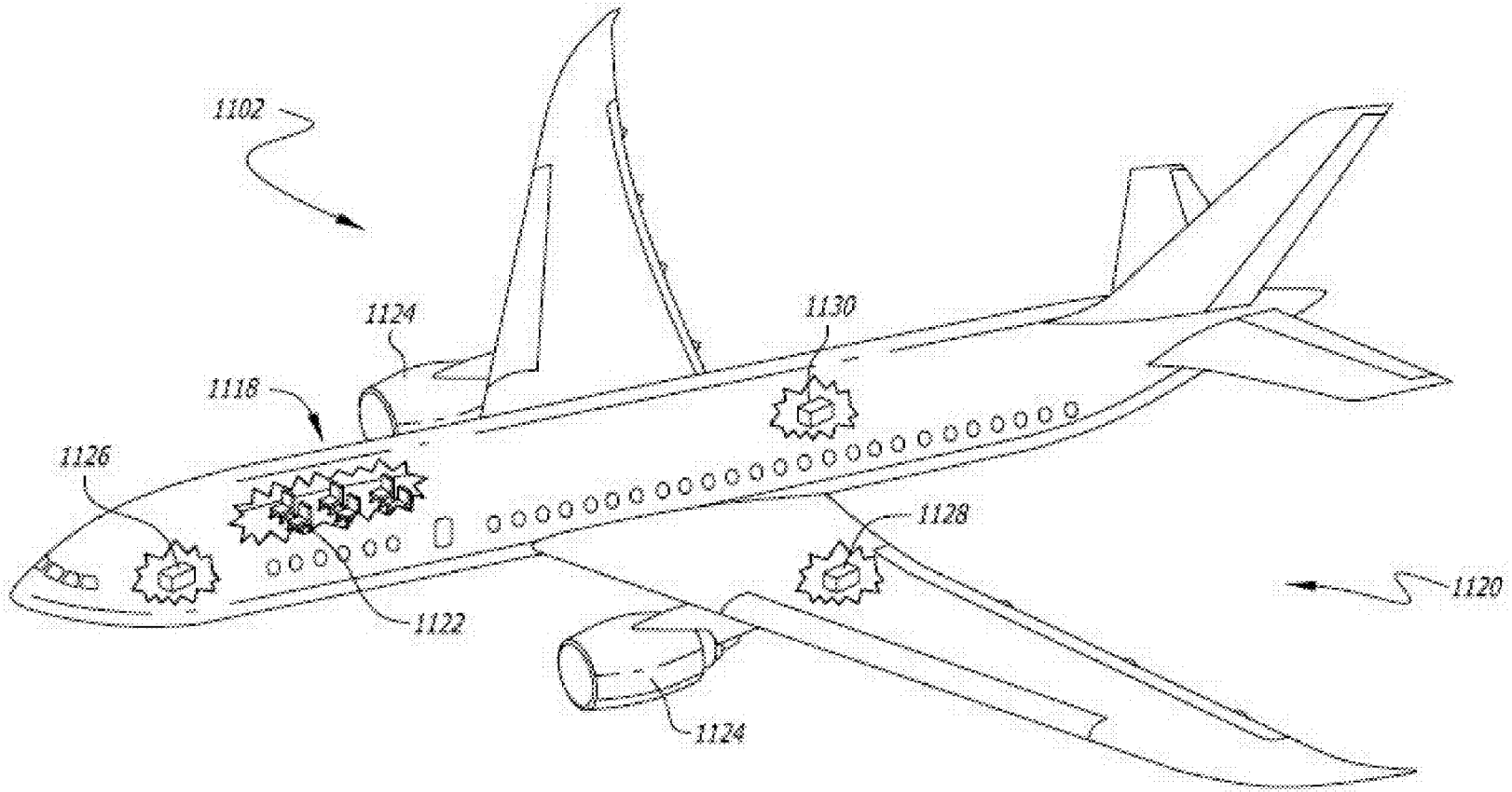
FIG. 6 is a block diagram illustrating various key components of an aircraft, in accordance with some examples.

In FIGS. 5 and 6, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 5 and 6 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

An aircraft manufacturing and service method 1100 shown in FIG. 5 and aircraft 1102 shown in FIG. 6 will now be described to better illustrate various features of processes and systems presented herein. During pre-production, aircraft manufacturing and service method 1100 may include specification and design 1102 of aircraft 1130 and material procurement 1104. The production phase involves component and subassembly manufacturing 11011 and system integration 1108 of aircraft 1130. Thereafter, aircraft 1130 may go through certification and delivery 1110 in order to be placed in service 1112. While in service by a customer, aircraft 1130 is scheduled for routine maintenance and service 1114 (which may also include modification, reconfiguration, refurbishment, and so on). While the examples described herein relate generally to servicing of commercial aircraft, they may be practiced at other stages of the aircraft manufacturing and service method 1100. For example, a method of installing rivets using self-aligning riveting tools (described herein) may be implemented at various stages of aircraft production.

Each of the processes of aircraft manufacturing and service method 1100 may be performed or carried out by a system integrator, a third party, and/or an operator (e.g., a customer). For the purposes of this description, a system integrator may include, without limitation, any number of aircraft manufacturers and major-system subcontractors; a third party may include, for example, without limitation, any number of venders, subcontractors, and suppliers; and an operator may be an airline, leasing company, military entity, service organization, and so on.

As shown in FIG. 6, aircraft 1102 produced by aircraft manufacturing and service method 1100 may include airframe 1132, interior 11311, and multiple systems 1134 and interior 11311. Examples of systems 1134 include one or more of propulsion system 1138, electrical system 1140, hydraulic system 1142, and environmental system 1144. Any number of other systems may be included in this example. Although an aircraft example is shown, the principles of the disclosure may be applied to other industries, such as the automotive industry.

Self-aligning riveting tools and methods for installing rivets using such tools embodied herein may be employed during any one or more of the stages of aircraft manufacturing and service method 1100 or, more specifically, during operations 1108, 1110, 1116, and 1118. For example, without limitation, components or subassemblies corresponding to component and subassembly manufacturing 1106 may be fabricated or manufactured in a manner similar to components or subassemblies produced while aircraft 1130 is in service.

Also, one or more self-aligning riveting tools examples, method examples, or a combination thereof may be utilized during component and subassembly manufacturing 1106 and system integration 1108, for example, without limitation, by substantially expediting assembly of or reducing the cost of aircraft 1130. Similarly, one or more of self-aligning riveting tools examples, method examples, or a combination thereof may be utilized while aircraft 1130 is in service, for example, without limitation, to maintenance and service 1114 may be used during system integration 1108 and/or maintenance and service 1114 to determine whether parts may be connected and/or mated to each other.

CONCLUSION

Although the foregoing concepts have been described in some detail for purposes of clarity of understanding, after reading the above-disclosure it will be apparent that certain changes and modifications may be practiced within the scope of the appended claims. It should be noted that there are many alternative ways of implementing the processes, systems, and self-aligning riveting tools. Accordingly, the present examples are to be considered as illustrative and not restrictive.

In the above description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

What is claimed is:

1. A method of installing a rivet for coupling a first part with a second part using a self-aligning riveting tool, the method comprising:

positioning an aligning sleeve of the self-aligning riveting tool over a rivet head of the rivet, the rivet head protruding from a first part, the aligning sleeve maintaining a concentric orientation of a first die relative to the rivet;

contacting a shank end of the rivet with a second die of the self-aligning riveting tool, the second die maintaining a concentric orientation of a die holder relative to the rivet;

advancing the first die toward the die holder until the rivet head contacts the first die and until the die holder contacts an inner contact surface of the second die; and forming a rivet tail of the rivet at the shank end.

2. The method of claim 1, wherein the shank end of the rivet is contacted with the second die before positioning the aligning sleeve of the self-aligning riveting tool such that the first die is advanced toward the die holder while the shank end of the rivet is in contact with the second die.

3. The method of claim 1, wherein the aligning sleeve maintains a concentric orientation of the first die relative to the rivet while advancing the first die toward the die holder and forming the rivet tail.

4. The method of claim 1, wherein the second die maintains a concentric orientation of the die holder relative to the rivet while contacting the shank end of the rivet with the second die and forming the rivet tail.

5. The method of claim 1, wherein positioning the aligning sleeve over the rivet head comprises biasing the aligning sleeve toward the first part and relative to the first die.

6. The method of claim 5, wherein biasing the aligning sleeve toward the first part and relative to the first die is performed using a first biasing device disposed over the first die such that the first die protrudes through the first biasing device.

7. The method of claim 6, wherein the first biasing device is a spring.

8. The method of claim 5, wherein biasing the aligning sleeve toward the first part and relative to the first die further comprising biasing the first die away from the rivet head.

9. The method of claim 1, wherein, after positioning the aligning sleeve over the rivet head, and prior to advancing the first die toward the die holder, the first die is positioned away from the rivet head.

10. The method of claim 1, wherein contacting the shank end with the second die comprises biasing the second die toward the shank end and relative to the die holder.

11. The method of claim 10, wherein biasing the second die toward the shank end and relative to the die holder is performed using a second biasing device disposed inside the second die.

12. The method of claim 11, wherein the die holder at least partially protrudes through the second biasing device.

13. The method of claim 11, wherein the second biasing device is a spring.

14. The method of claim 10, wherein biasing the second die toward the shank end and relative to the die holder comprises biasing the die holder away from an inner contact surface of the second die.

15. The method of claim 1, wherein, after contacting the shank end with the second die, and prior to advancing the first die toward the die holder, the die holder is positioned away from an inner contact surface of the second die.

16. The method of claim 1, wherein advancing the first die toward the die holder comprises sliding the first die relative to the aligning sleeve along a center axis of the self-aligning riveting tool.

17. The method of claim 1, wherein advancing the first die toward the die holder comprises sliding the die holder relative to the second die along a center axis of the self-aligning riveting tool.

18. The method of claim 17, wherein advancing the first die toward the die holder further comprises sliding the first die relative to the aligning sleeve along the center axis of the self-aligning riveting tool, and wherein sliding the first die relative to the aligning sleeve overlaps in time with sliding the die holder relative to the second die.

19. The method of claim 1, wherein advancing the first die toward the die holder comprises maintaining contact between the aligning sleeve and the first part.

20. The method of claim 1, wherein forming the rivet tail comprises advancing the second die toward the second part.

21. The method of claim 1, further comprising:

measuring a combined thickness of the first part and the second part; and selecting the rivet based, at least in part, on the combined thickness.

22. The method of claim 21, further comprising selecting the self-aligning riveting tool based, at least in part, on the combined thickness.

23. The method of claim 22, wherein selecting the self-aligning riveting tool based on the combined thickness comprises selecting the second die and the die holder based on the combined thickness.

24. The method of claim 22, wherein selecting the self-aligning riveting tool based on the combined thickness comprises adjusting a slidable distance between the second die and the die holder based on the combined thickness.

25. The method of claim 1, wherein, after positioning the aligning sleeve of the self-aligning riveting tool over the rivet head of the rivet, the first die and the rivet are coaxial.

26. The method of claim 1, wherein the aligning sleeve is slidably coupled to the first die of the self-aligning riveting tool.

27. The method of claim 1, wherein the second die is slidably coupled to the die holder of the self-aligning riveting tool.

28. The method of claim 1, wherein positioning the aligning sleeve over the rivet head comprises engaging a circumferential edge of the rivet head with the aligning sleeve.

29. The method of claim 1, wherein contacting the shank end with the second die comprises protruding an aligning portion of the second die into an opening at the shank end.

* * * * *